US006125640A

United States Patent [19]

Kim

[11] Patent Number: 6,125,640

[45] Date of Patent: Oct. 3, 2000

[54] METHOD OF CONTROLLING A SYSTEM HAVING MULTIPLE AIR CONDITIONER UNITS

[75] Inventor: Kyung Sik Kim, Incheon, Rep. of Korea

[73] Assignee: LG Electronics, Inc., Seoul, Rep. of Korea

[21] Appl. No.: 08/852,130

[22] Filed: May 6, 1997

[30] Foreign Application Priority Data

May 6, 1996 [KR] Rep. of Korea ..... 96-14686

[51] Int. Cl.[7] ..... F25B 7/00

[52] U.S. Cl. ..... 62/175; 62/160; 165/207; 165/208; 236/1 B

[58] Field of Search ..... 62/160, 175; 165/207, 165/208; 236/1 B

[56] References Cited

U.S. PATENT DOCUMENTS

| | | | |
|---|---|---|---|
| 4,122,893 | 10/1978 | Thompson | 165/16 |
| 4,192,455 | 3/1980 | Rasmussen et al. | 237/8 R |
| 5,050,396 | 9/1991 | Ohkoshi et al. | 62/160 |
| 5,297,392 | 3/1994 | Takata et al. | 62/160 |
| 5,343,935 | 9/1994 | Sumitani | 165/22 |
| 5,467,604 | 11/1995 | Sekigami et al. | 62/117 |
| 5,495,887 | 3/1996 | Kathnelson et al. | 165/11.1 |
| 5,592,824 | 1/1997 | Sogabe et al. | 62/127 |
| 5,720,179 | 2/1998 | Jung | 62/160 |
| 5,860,473 | 1/1999 | Seiden | 165/208 |
| 5,904,047 | 5/1999 | An | 62/81 |

*Primary Examiner*—John Sollecito
*Assistant Examiner*—Marc Norman

[57] ABSTRACT

A method of controlling a system with multiple air conditioner units having an outdoor machine and a plurality of indoor machines, which detects different driving modes input to each indoor machine, compares an outdoor temperature with first and second predetermined temperatures, and drives a corresponding indoor machine in accordance with the comparison results.

16 Claims, 2 Drawing Sheets warming mode cooling mode

METHOD OF CONTROLLING A SYSTEM HAVING MULTIPLE AIR CONDITIONER UNITS

BACKGROUND OF THE INVENTION

This invention relates to a system having multiple air conditioners, and more particularly to a method of controlling a system having multiple air conditioners which is perfomed in a cooling mode or a warming mode corresponding to changing of outdoor temperature when a user demands a cooling mode and a warming mode at the same time.

In a conventional air conditioner, when the cooling mode and the warming mode are requested for each room at the same time, i.e., when different driving signals are inputted to the air conditioner, the air conditioner is driven in accordance with the originally set up driving mode of an indoor machine, while another indoor machine which has a second driving mode alarms the user. Further when the first driving mode is finished, after a compressor becomes off-state, the indoor machine having the second driving mode is operated.

Referring to a conventional heat pump air conditioner as shown in FIG. 1, if a warming driving mode is inputted to the air conditioner under the state where the first indoor machine A is driving at a cooling mode and the second indoor machine B is inactive, the indoor machine A continually executes driving the cooling mode and the indoor machine B alarm generates sound in the inactive state. Secondly, if each indoor machine requires a different driving mode under the state that both of the indoor machine A and the indoor machine B are inactive, two driving modes of the indoor machines A, B become the same in the inactive state with alarms, or the air conditioner is driven only when the off-signal is inputted to one indoor machine A or B.

In the conventional multiple air conditioner system, however, when different driving modes are inputted by the user to each indoor machine, it is problem that the driving mode of an indoor machine currently being driven decides the driving mode of the air conditioner without considering the user's preference or current response to the air conditioner and an indoor and outdoor temperature.

SUMMARY OF THE INVENTION

Since the present invention is accomplished in view of the foregoing problem, it is an object of the invention to provide a method of controlling a system having multiple air conditioner units, which controls driving modes of indoor machines in accordance with an outdoor temperature.

In order to achive the object as previously discussed and other objects, a method of controlling a system having multiple air conditioner units according to the present invention, specially in case where one outdoor machine is connected with a plurality of indoor machines, comprises the steps of judging different driving modes to each other, and driving a corresponding indoor machine in accordance with the comparing the value as a result of comparing outdoor temperature with a predetermined first temperature and second temperature.

In the above step, if the outdoor temperature is more than the first temperature T1, an indoor machine having a cooling driving mode is driven. Further, if the outdoor temperature is less than the second temperature T2 (T2 is less than or equal to T1) an indoor machine having a warming driving mode is driven. If the outdoor temperature is between the first temperature T1 and the second temperature T2, an indoor machine the originally set up driving mode by the user is driven.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed descriptions.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF PRESENT INVENTION

Hereinafter a method for controlling a system having multiple air conditioner units according to this invention is discussed in detail with reference to the accompanying drawings.

Figure 1:
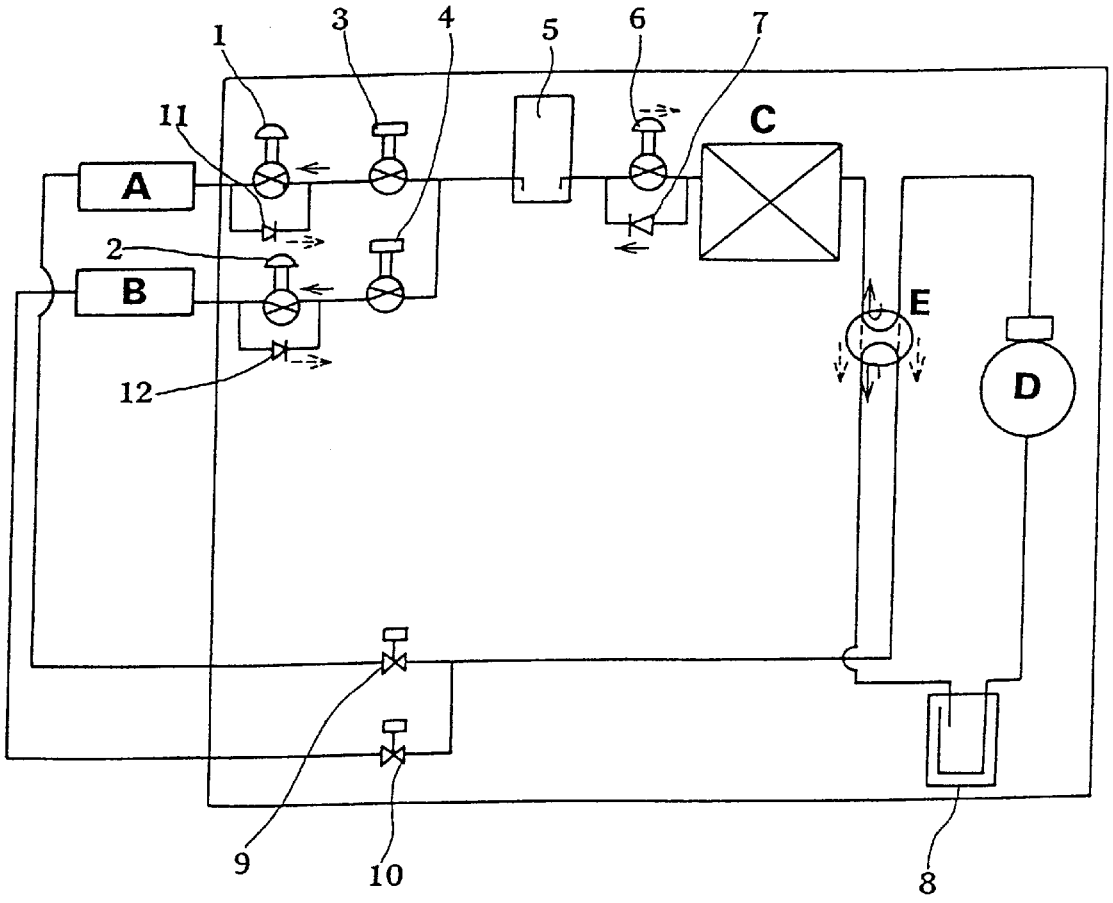
FIG. 1 PRIOR ART
FIG. 1 is a drawing showing a cycle of a traditional two room driving air conditioner.

In a multiple air conditioner system having a plurality of indoor machines and one outdoor machine as shown in FIG. 1, if the driving mode is a cooling mode, a refrigerant(not illustrated) having high temperature and pressure and outflowing from a compressor D is condensed in the outdoor machine C as a function of heat exchanger) via a four way valve E. The condensed high pressure refrigerant expands via an inverse valve 7 for cooling the refrigerant and the storage device 5 stores the refrigerant as liquid refrigerant with two solenoid valves 3,4 for maintaining the constant mass of the refrigerant and two fixed temperature type expansion valves 1,2 for inhibiting the flow of the refrigerant to the compressor D. The expanded low pressure refrigerant having a low degree of dryness evaporates during its pass over two indoor machines(as function of heat exchanger) A,B, and then the over-heated low pressure refrigerant having a high temperature is flowed to the compressor D via two ON/OFF solenoid valves 9,10, the four way valve E and an accumulator 8 in such order.

If the driving mode is a warming mode, the refrigerant having high temperature and pressure and outflowing from the compressor D is condensed in the indoor machine A,B via the four way valve E and the ON/OFF solenoid valves 9,10. And the condensed high pressure refrigerant is first expanded in the solenoid valves 3,4 via two inverse valves 11,12 for warming the flowing refrigerant and secondly expanded in a fixed temperature type expansion valve 6 through the storage device 5. The expanded low pressure refrigerant having a low degree of dryness evaporates during its pass over the outdoor machine C, and then the overheated low pressure refrigerant having high temperature is flowed to the compressor D via the four way valve E and the accumulator 8 in such order.

According to a method of controlling the system having multiple air conditioner units in accordance with the present invention, where the user inputs two different signals, one signal for the cooling mode and another signal for the warming mode, a movement of the multiple air conditioner is excuted by a cycle as described hereinafter.

If an outdoor temperature is more than a first preset temperature T1, one indoor machine having a cooling driving mode is driven while another indoor machine having a warming mode is not driven but lights up a lamp which represents that the machine is standing by ready to be driven. Further if the outdoor temperature is less than a second preset up temperature T2 (T2 is less than or equal to T1), one indoor machine having a warming driving mode is driven, but another indoor machine having a cooling mode is not drived and lights up a lamp which represents that the machine is standing by ready to be driven. If the outdoor temperature is between the first preset temperature T1 and the second preset up temperature T2, one indoor machine having the originally set up driving mode by the user is driven, but another indoor machine having the driving mode which is different from the originally set up driving mode is not drived and lights up the lamp which represents that the machine is standing by ready to be driven.

Figure 2:
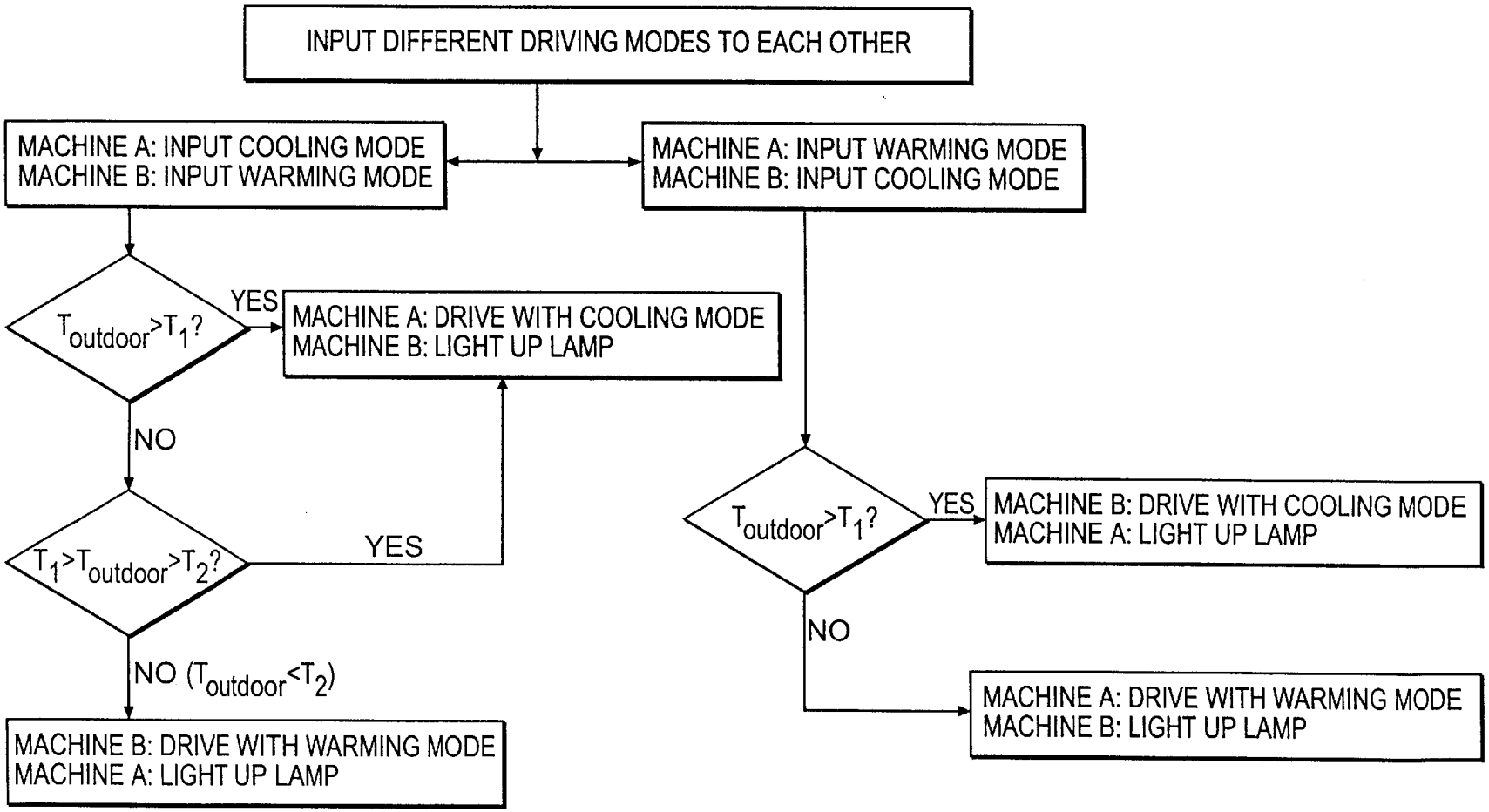
FIG. 2 is a flowchart showing a method for controlling a system having multiple air conditioner units in accordance with the present invention.

FIG. 2 is a flowchart showing the preferred embodiment of a method for controlling an air conditioner in accordance with this invention, where an indoor machine which is previously driven is called a machine A in the following.

There are cases of different two driving modes inputted by the user. The first case has an indoor machine A have a cooling mode and another indoor machine B have a warming mode, and the second case has the indoor machine A have the warming mode and the indoor machine B have the cooling mode.

In the first case, only in a case where the present outdoor temperature is less than the second preset temperature T2, the indoor machine B is driven at the warming mode while the indoor machine A is not driven but lights up the lamp. In a case where the present outdoor temperature is more than the second temperature T2, the indoor machine A is driven at the cooling mode while the indoor machine B is not driven but lights up the lamp.

In the second case, only in a case where the present outdoor temperature is more than the first preset temperature T1, the indoor machine B is driven at the cooling mode but the indoor machine A is not driven and lights up the lamp. In a case where the present outdoor temperature is less than the first temperature T1, the indoor machine A is drived at the warming mode while the indoor machine B is not driven but lights up the lamp.

As discussed above, in a method for controlling an air conditioner in accordance with this invention, when the user inputs two different driving modes for a room having a plurality of indoor machines, it is possible to control the driving mode of the indoor machines according to the outdoor temperature.

Having described a specific embodiment of our bearing, it is believed obvious that modifications and variations of our invention are possible in light of the above teachings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of controlling a multiple air conditioner system having one outdoor machine and a plurality of indoor machines, comprising:

detecting a plurality of different driving modes input to the indoor machines;

comparing an outdoor temperature with a first predetermined temperature;

comparing the outdoor temperature with a second predetermined temperature if a previously driven indoor machine was driven in a cooling mode; and driving a corresponding indoor machine in accordance with a result of said comparing steps.

2. A method of controlling a system with multiple air conditioner units in accordance with claim 1, wherein in the driving step, when the outdoor temperature is greater than the first predetermined temperature, an indoor machine having a cooling mode is driven, while when the outdoor temperature is less than the second predetermined temperature, an indoor machine having a warming mode is driven.

3. A method in accordance with claim 2, wherein in the driving step, when the outdoor temperature is between the first predetermined temperature and the second predetermined temperature, an indoor machine having a driving mode input by a user is driven.

4. A method in accordance with claim 1, wherein in the detecting step, a cooling mode is input to a first one of the indoor machines, and a warming mode is input to a second one of the indoor machines.

5. A method in accordance with claim 4, wherein in the driving step, if the outdoor temperature is greater than the first predetermined temperature, the first one of the indoor machines is driven in the cooling mode while the second one of the indoor machines is not driven in the warming mode.

6. A method in accordance with claim 5, wherein in the driving step, the second one of the indoor machines, which is not driven, visually alerts a user.

7. A method in accordance with claim 4, wherein in the driving step, if the outdoor temperature is between the first predetermined temperature and the second predetermined temperature, the first one of the indoor machines is driven in the cooling mode while the second one of the indoor machines is not driven in the warming mode.

8. A method in accordance with claim 4, wherein in the driving step, if the outdoor temperature is less than the second predetermined temperature, the second one of the indoor machines is driven in the warming mode while the first one of the indoor machines is not driven in the warming mode.

9. A method in accordance with claim 8, wherein the driving step, the first one of the indoor machines, which is not driven, visually alerts a user.

10. A method in accordance to claim 1, wherein the second predetermined temperature is less than the first predetermined temperature.

11. A method in accordance with claim 1, wherein in the detecting step, a warming mode is input to a first one of the indoor machines, and a cooling mode is input to a second one of the indoor machines.

12. A method in accordance with claim 11, wherein in the driving step, if the outdoor temperature is greater than the first predetermined temperature, the second one of the indoor machines is driven in the cooling mode while the first one of the indoor machines is not driven.

13. A method in accordance with claim 11, wherein in the driving step, if the outdoor temperature is less than or equal to the first predetermined temperature, the first one of the indoor machines is driven in the warming mode while the second one of the indoor machines is not driven.

14. A method of controlling a multiple air conditioner system having at least two indoor machines, one of which having been previously driven, for which a user has input two different driving modes, comprising:

comparing an outdoor temperature with a first predetermined temperature; and driving a first indoor machine with a cooling mode if the outdoor temperature is greater than the first predetermined temperature;

driving a second indoor machine with a warming mode if the outdoor temperature is less than the first predetermined temperature and the second indoor machine is the previously driven machine;

comparing the outdoor temperature with a second predetermined temperature if the outdoor temperature is less than the first predetermined temperature and the first indoor machine is the previously driven machine; and driving the second indoor machine with a warming mode if the outdoor temperature is less than the second predetermined temperature.

15. The method of claim 14, further comprising:

driving the first indoor machine with a cooling mode if the outdoor temperature is greater than the second predetermined temperature and the first indoor machine is the previously driven machine.

16. The method of claim 14, further comprising:

visually alerting a user of the machine of the first indoor machine and the second indoor machine which is not driven.

* * * * *